US007048538B2

(12) United States Patent
Albizuri

(10) Patent No.: US 7,048,538 B2
(45) Date of Patent: May 23, 2006

(54) GAS DISTRIBUTION ASSEMBLY WITH ROTARY TAPS FOR A COOKING APPLIANCE

(76) Inventor: Iñigo Albizuri, Calle Uno, No. 736 Z.I. 44940 Guadalajara, Jalisco (MX)

( * ) Notice: Subject to any disclaimer, the term of this patent is extended or adjusted under 35 U.S.C. 154(b) by 146 days.

(21) Appl. No.: 10/850,330

(22) Filed: May 19, 2004

(65) Prior Publication Data

US 2005/0196718 A1 Sep. 8, 2005

(30) Foreign Application Priority Data

Mar. 3, 2004 (ES) ..... 200400511 U

(51) Int. Cl.
*F23Q 9/08* (2006.01)

(52) U.S. Cl. ..... 431/280; 431/278; 126/39 N

(58) Field of Classification Search ..... 431/280, 431/278; 126/39 N, 39 L
See application file for complete search history.

(56) References Cited

U.S. PATENT DOCUMENTS 4,705,018 A * 11/1987 Beach ..... 126/39 N
4,705,019 A * 11/1987 Beach et al. ..... 126/39 E
6,074,201 A * 6/2000 Muhle ..... 431/354

* cited by examiner

*Primary Examiner*—Alfred Basichas
(74) *Attorney, Agent, or Firm*—The Kline Law Firm

(57) ABSTRACT

The gas distribution assembly (1) is adapted for the supply of a gas flow (G) to a cooking appliance with top burners, and comprises a straight tubular-shaped manifold conduit. (2) and various rotary taps (C1–C4) provided with an arched mounting base, which are superimposed in twos opposite to each other on a tubular part (2*b*) of the manifold, and fixed by means of common screws (10). The tap drive shafts (16) stand out from the horizontal cooking plane (CP) occupying a small-sized square geometric area (D×D) . A supporting leg (12) for the distribution assembly (1) is made of a plate folded and fixed on a horizontal structural base (SB), the gas feeder nipple (3) being connected to a central hollow part (2*a*) of the manifold, extended in a direction opposite to that of the drive shafts (16).

4 Claims, 1 Drawing Sheet

GAS DISTRIBUTION ASSEMBLY WITH ROTARY TAPS FOR A COOKING APPLIANCE

TECHNICAL FIELD OF THE INVENTION

The present description relates to the supply of gas to a household cooking appliance provided with various top burners by way of a gas flow distribution assembly fitted with a number of rotary type regulating taps mounted on a manifold conduit, and to a constructional detail for the installation of the manifold assembly on an appliance wall.

PRIOR ART

Fuel gas distribution assemblies fitted with manual rotary type taps are already well known. They are installed on a panel of the cooking appliance frame with the tap drive shafts aligned on the front panel of the appliance or forming a square projecting above the horizontal cooking plane. The gas manifold assembly disclosed for instance in GB-2182429-A comprises a main round section distribution pipe or common rail on which a number of manual rotary taps are fitted in line. The manifold pipe or gas rail has its two ends sealed with plugs and each tap takes the gas flow from an individual hole in the manifold pipe. The taps are the type that has an arched mounting base with a built-in gas inlet. The tap is connected to the round gas rail by superimposing its arched base encircling the distribution pipe, with matching geometrical shapes, and secured to it with screws. The individual tap outlet pipes run in a direction at right angles to the front panel of the appliance.

In U.S. Pat. No 4,705,018-A a gas cooker appliance is disclosed provided with a gas distribution system, which comprises a round flat-surfaced manifold box, four individual taps mounted on the box for supplying a gas flow to four top burners, a gas feed nipple connected to the manifold box on the side opposite to the taps, and at least one support leg for anchoring to the frame of the appliance. On this manifold box the taps form a geometrical square with the drive shafts facing upwards. The gas outlet of the taps is oriented with an angle of inclination in relation to the front and side panels of the appliance, above the upper cooking plane of the appliance. This arrangement of the manifold assembly occupies a small surface area and the orientation of the outlet pipes crossing one another is used in cooking appliance with four control knobs positioned on the top surface of the appliance. This known distribution assembly has a structurally complex and economically expensive gas manifold box.

DISCLOSURE OF THE INVENTION

The object of the invention is a gas distribution assembly, fitted with a number of manual taps adapted for the supply of a flow of gas to the top burners of a cooking appliance, wherein the taps provided with a arched mounting base, are arranged on a manifold conduit oppositely superimposed in twos on the conduit, and the drive shafts of the taps being arranged on a small-sized geometrical area on the cooking top plane of the appliance.

The gas distribution assembly according to the invention is of simple configuration and economic construction adapted for the installation of an existing type of gas tap, with the mounting base arched. The gas manifold assembly comprises a straight manifold conduit, which has a central part wherein the gas feeder nipple is connected, and two tubular parts on each of which are fitted two oppositely superimposed taps, encircling the tubular part and secured to it by means of common screws.

To facilitate the connection and installation of the supply pipe to each cooking appliance burner, the gas distribution assembly also comprises an elbow-shaped gas flow connecting adapter in each tap outlet, whereby the connecting adapter changes the right-angle orientation to the front plane of the appliance, typical of the outlet body of the existing tap, to an outlet conduit oriented in a horizontal and radial direction with an acute angle of inclination in relation to this front plane.

DETAILED DESCRIPTION OF THE PREFERRED EMBODIMENT

Figure 1:
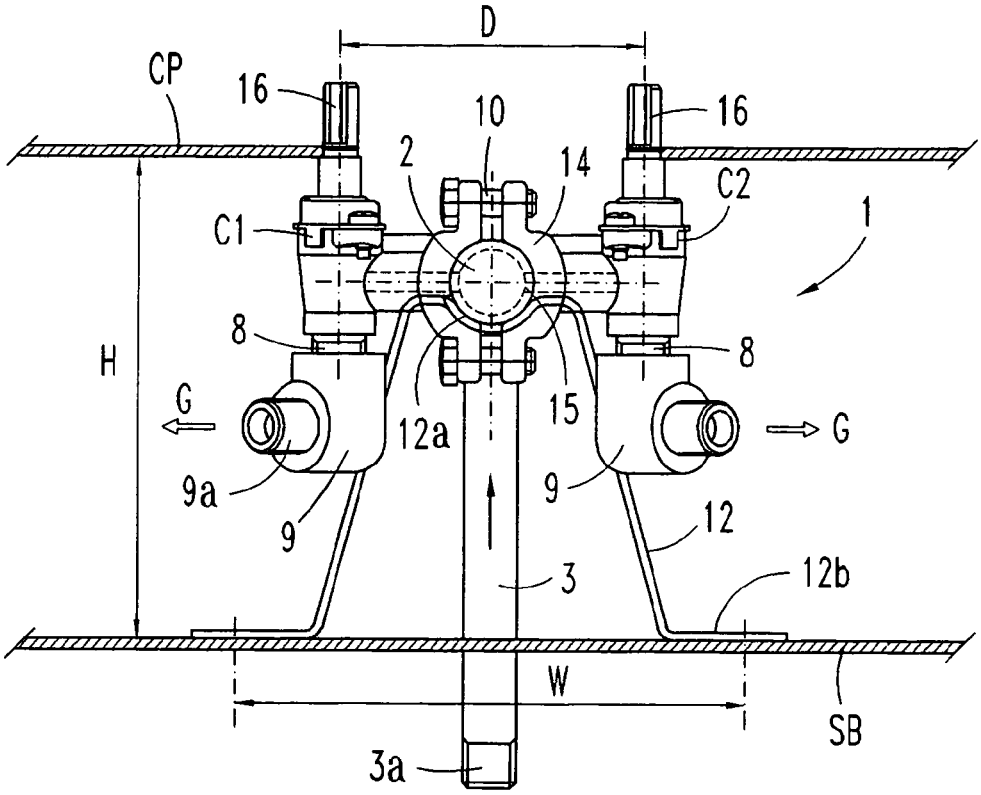
FIG. 1 is an elevational view of a gas distribution assembly mounted in an cooking appliance, provided with four gas taps.
Figure 2:
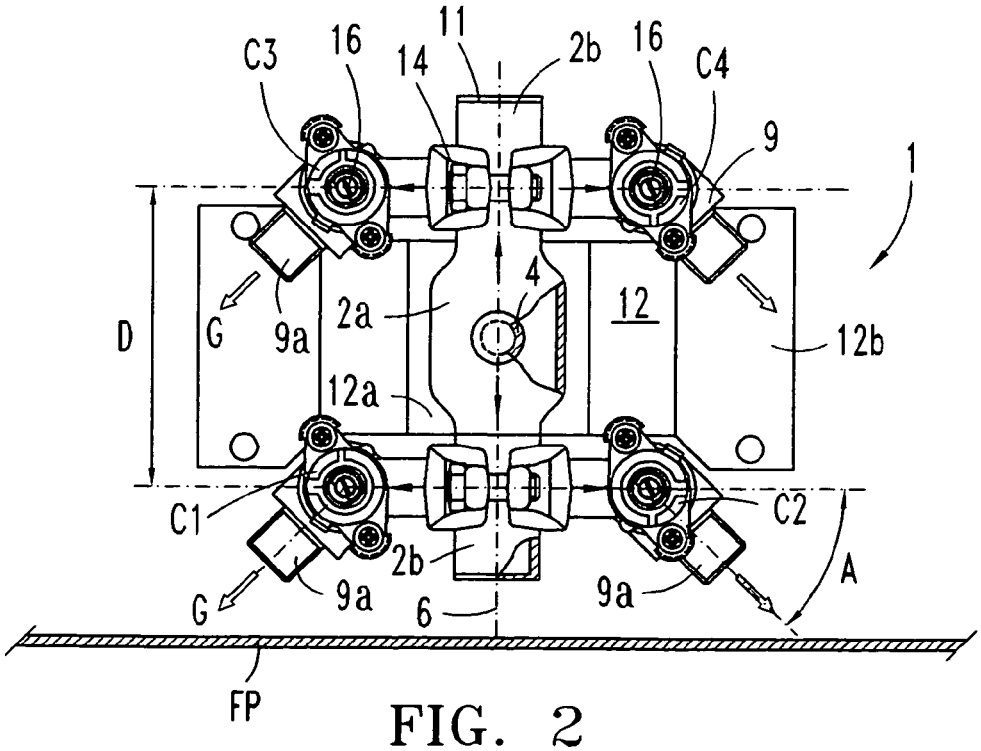
FIG. 2 is a plan view of the gas distribution assembly of FIG. 1.

In reference to FIGS. 1 and 2 a gas distribution assembly embodiment 1 is described as adapted to a cooking appliance with four top burners, comprising a manifold conduit 2 and a gas feeder nipple 3 connected to the manifold conduit, two pairs of taps C1–C4 provided with a tap outlet pipe 8 for the supply of an individual gas flow "G", a connecting adapter 9 for this tap outlet, and a supporting leg 12 made of folded plate for fixing the manifold assembly 1. The gas distribution assembly is fastened on a horizontal base "SB" of the cooking appliance frame, the manifold conduit 2 being oriented according to an axis 6 at right angles to the front panel "FP" of the appliance, and the tap drive shafts 16 stand out from the horizontal cooking plane "CP" of the appliance in an upward direction, preferably forming a geometric square.

The manifold conduit 2 has a straight tubular shape, and is formed with a wide central part 2*a* for connecting the feeder nipple 3, and two narrower tubular parts 2*b*, one on either side, for fitting the taps C1–C4 in paired twos. The tubular parts 2*b* for mounting the taps are arched or round and are sealed by a plug at each end.

The taps C1–C4 have a mounting base 14 to be superimposed on the tubular part of the manifold conduit 2. As the number of appliance burners is preferably four, the two arched bases 14 of each pair of taps C1–C2 and C3–C4 are oppositely engaging on the round surface of the tubular part 2*b*, wholly encircling it between both, and they are fastened by means of a pair of common screws 10. Both taps C1–C2 and C3–C4 of each pair are connected directly to the manifold conduit 2 by way of a respective gas intake hole 15 in each of the tubular parts 2*b*.

The supporting leg 12 of the manifold assembly 1 is formed with an arched surface 12*a* on which the manifold conduit 2 is held, and two fastening wings 12*b* which are fixed to said structural base "SB" of the appliance, separated from each other by space width "W". The four tap drive shafts 16 standing out from the cooking plane "CP" are spaced preferably the same length "D" apart between the two paired taps C1, C2 as between taps C1,C3 of different pair, for instance around 57 cm. The gas distribution assembly 1 installed in this way, occupies a cubic volume of height "H" and width "W" (FIG. 1) of around 95×95 mm, including the connecting adapters 9.

The gas feeder nipple 3 is rigid and connected to a central intake hole 4 in the manifold conduit 2. The free end 3*a* of the gas nipple 3 in order to be connected to a gas source, is extended below the supporting leg 12 and outside the cubic space "H×W" for housing the distribution assembly 1 within the cooking appliance.

The manifold assembly 1 uses four taps C1–C4 of an existing type, which are used previously mounted on manifold conduits aligned along on an appliance front panel. On the cooking appliance for which the gas distribution assembly 1 is adapted, the burners are located on the top cooking plane "CP", in a position adjacent to the front plane "FP". In order that the burner rigid tubes may run in a direction parallel to the front plane "FP", each tap C1–C4 has an adapter 9 which is provided with an outlet pipe 9*a*, running horizontally on this structural base "SB" and oriented according to this radial direction with an acute angle of inclination "A" in relation to the front plane "FP".

What it is claimed is:

1. Gas distribution assembly fitted with various taps, adapted for the supply of a gas flow (G) to the top burners of a cook appliance provided with a horizontal cooking plane (CP) and a vertical front wall (FP) comprising:

a gas manifold conduit (2) supported under said horizontal cooking plane (CP) and provided with a gas conducting central part (2*a*) connected to a gas feeder nipple (3);

said various taps (C1–C4) being of a rotary type, each provided with an outlet conduit (8) for supplying a gas flow (G) to the respective burner, a drive shaft (16) for regulating said gas flow (G), and an arched mounting base (14) having a built-in gas inlet connected directly to the manifold conduit (2);

wherein the manifold conduit (2) is of a straight configuration and has at least one mounting tubular part (2*b*) extended axially from said conducting central part (2*a*), and adapted in its shape for the fitting of two rotary taps (C1–C4), with their mounting bases (14) superimposed opposite each other encircling the manifold tubular part (2*b*), and attached to it by means of common screws (10);

a supporting means (12) for the gas distribution assembly (1) within a housing (H×W) of the cooking appliance, anchored on a horizontal structural base (SB) of the appliance, with a horizontal central axis (6) of the manifold conduit oriented at right angles to this front wall (FP) of the appliance, and the tap drive shafts (16) standing out of said cooking plane (CP);

wherein, as there are three or four taps (C1–C4) mounted on the gas manifold conduit (2), their drive shafts (16) occupy a geometric square (D×D) drawn by them on the horizontal cooking plane (CP).

2. The gas manifold assembly fitted with various taps according to claim 1, wherein the manifold conduit (2) being of a straight configuration is provided with said gas conducting central part (2*b*) in communication with at least one tubular part (2*a*) for installing two taps (C1–C4), receiving one end of said gas feeder nipple (3) for its connection, and the latter extended in the direction opposite to that of the tap drive shafts (16).

3. The gas distribution assembly fitted with various taps according to claim 1, wherein said means (12,SB) for supporting the gas distribution assembly (1), comprises a supporting leg (12) formed by means of an upper arched bearing part (12*a*) for holding said manifold central part (2*a*), and two lower fastening wings (12*b*) a given width (W) apart from each other, which are anchored to said structural base (SB) of the appliance, so the gas distribution assembly (1) occupies a cubic space (H×W) adjacent to the front panel (FP), and the gas feeder nipple (3) is connected to a gas source below the structural base (SB).

4. The gas manifold assembly fitted with various taps according to claim 1, wherein the taps (C1–C4) are provided with an connecting adapter (9) in the each tap outlet (8) for connecting the gas flow (G) to the respective top burner, by an adapter outlet pipe (9*a*) running horizontally, and oriented in a radial direction with an angle of inclination (A) relative to the front panel (FP).

* * * * *